US010784611B2

(12) United States Patent
Huang et al.

(10) Patent No.: US 10,784,611 B2
(45) Date of Patent: Sep. 22, 2020

(54) ELECTRICAL CONNECTOR ASSEMBLY AND PLUG WITH GUIDE SURFACE FOR INSERTION INTO SOCKET CONNECTOR

(71) Applicant: LOTES CO., LTD, Keelung (TW)

(72) Inventors: Chang Wei Huang, Keelung (TW); Tung Ming Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/583,526

(22) Filed: Sep. 26, 2019

(65) Prior Publication Data

US 2020/0112117 A1 Apr. 9, 2020

(30) Foreign Application Priority Data

Oct. 9, 2018 (CN) ..... 2018 1 1171575

(51) Int. Cl.

| | |
|---|---|
| ***H01R 13/213*** | (2006.01) |
| ***H01R 13/627*** | (2006.01) |
| ***H01R 13/6585*** | (2011.01) |
| *H01R 107/00* | (2006.01) |

(52) U.S. Cl.

CPC ..... *H01R 13/213* (2013.01); *H01R 13/627* (2013.01); *H01R 13/6585* (2013.01); *H01R 2107/00* (2013.01)

(58) Field of Classification Search

CPC ..... H01R 13/193; H01R 24/86

See application file for complete search history.

(56) References Cited

U.S. PATENT DOCUMENTS 6,530,788 B1 * 3/2003 Ju ..... H01R 12/57 439/83
6,572,397 B2 * 6/2003 Ju ..... H05K 3/3426 439/342

(Continued)

FOREIGN PATENT DOCUMENTS

CN 201004523 Y 1/2008
CN 201549747 U 8/2010

(Continued)

*Primary Examiner* — Abdullah A Riyami
*Assistant Examiner* — Nader J Alhawamdeh
(74) *Attorney, Agent, or Firm* — Locke Lord LLP; Tim Tinkang Xia, Esq.

(57) ABSTRACT

An electrical connector assembly includes a plug, having a body and multiple pins positioned on the body, and a socket connector including an insulating body. Each pin has an insertion portion extending downward out of the body. The insertion portion has a guide surface, and two contact regions located above the guide surface. The guide surface passes through a vertical center line of the insertion portion. Multiple accommodating holes run through the insulating body vertically. Multiple terminals are respectively accommodated in the accommodating holes. Each terminal is provided with two clamping portions. The guide surfaces guide the pins to be inserted downward into the accommodating holes. When each pin is inserted downward to a final position, the insertion portion is located between the two clamping portions, the two clamping portions are correspondingly in contact with the two contact regions, and the guide surface is located below the two clamping portions.

20 Claims, 9 Drawing Sheets

(56) References Cited

U.S. PATENT DOCUMENTS

| | | | | |
|---|---|---|---|---|
| 7,771,244 | B1 * | 8/2010 | Ju | H01R 4/022 439/342 |
| 8,016,623 | B2 * | 9/2011 | Ju | H01R 13/112 439/342 |
| 8,047,864 | B1 * | 11/2011 | Ju | H01R 4/58 439/342 |
| 8,052,436 | B1 * | 11/2011 | Ju | H01R 12/57 439/342 |
| 10,601,157 | B2 * | 3/2020 | Huang | H01R 13/631 |
| 10,601,195 | B2 * | 3/2020 | Huang | H01R 13/405 |
| 2009/0088016 | A1 * | 4/2009 | Liao | H05K 3/3426 439/357 |
| 2017/0271801 | A1 * | 9/2017 | Liao | H01R 13/415 |
| 2020/0076108 | A1 * | 3/2020 | Huang | H01R 12/58 |
| 2020/0112117 | A1 * | 4/2020 | Huang | H01R 13/627 |

FOREIGN PATENT DOCUMENTS

| | | | |
|---|---|---|---|
| CN | 202134696 | U | 2/2012 |
| CN | 205646233 | U | 10/2016 |

* cited by examiner

100

ELECTRICAL CONNECTOR ASSEMBLY AND PLUG WITH GUIDE SURFACE FOR INSERTION INTO SOCKET CONNECTOR

CROSS-REFERENCE TO RELATED PATENT APPLICATION

This non-provisional application claims priority to and the benefit of, pursuant to 35 U.S.C. § 119(a), patent application Serial No. CN201811171575.4 filed in China on Oct. 9, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector assembly and a plug, and particularly to an electrical connector assembly allowing a plug to be smoothly inserted into a socket connector, and a plug thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector assembly includes: a plug, including a body and multiple pins accommodated in the body, where each pin has an insertion portion extending downward out of the body, and two opposite sides of a bottom end of the insertion portion are provided with two symmetrical chamfers; and a socket, including an insulating body and multiple terminals accommodated in the insulating body. Each terminal is provided with two contact portions. The chamfers guides a corresponding pin to be inserted downward into the insulating body. When each pin is inserted downward to a final position, the insertion portion is located between the two contact portions and clamped by the two contact portions.

However, since the two chamfers are symmetrically provided, the guiding path provided by the chamfers is shorter. When the pins are inserted downward, each pin may be inserted away from the correct insertion position, causing the pin to press the corresponding terminal or the insulating body downward, thereby damaging the terminal or the insulating body, and affecting the performance of the socket.

Therefore, a heretofore unaddressed need to design a new electrical connector assembly and plug exists in the art to address the aforementioned deficiencies and inadequacies.

SUMMARY

The present invention is directed to an electrical connector assembly and a plug, to provide better guidance for the plug to be smoothly inserted into a socket connector.

In order to achieve the foregoing objective, the present invention adopts the following technical solutions:

An electrical connector assembly includes: a plug, comprising a body and a plurality of pins positioned on the body, wherein each of the pins has an insertion portion extending downward out of the body, the insertion portion is provided with a guide surface, the guide surface passes through a vertical center line of the insertion portion, and the insertion portion is further provided with two contact regions being higher than the guide surface; and a socket connector, comprising an insulating body, wherein the insulating body is provided with a plurality of accommodating holes running through the insulating body vertically, a plurality of terminals are correspondingly accommodated in the accommodating holes respectively, each of the terminals is provided with two clamping portions, and the guide surfaces of the pins guide the pins to be inserted downward into the accommodating holes; wherein when each of the pins is inserted downward to a final position, the insertion portion is located between the two clamping portions, the two clamping portions are correspondingly in contact with the two contact regions, and the guide surface is located below the two clamping portions.

In certain embodiments, the guide surfaces of a portion of the pins are provided opposite to the guide surfaces of another portion of the pins.

In certain embodiments, a side surface of the insertion portion has two first flat surfaces opposite to each other and a second flat surface connecting the two first flat surfaces, the two contact regions are respectively provided on the two first flat surfaces, an upper end of the guide surface is connected to a bottom end of the second flat surface, and two opposite sides of the guide surface are connected to the two first flat surfaces.

In certain embodiments, an oblique surface is connected to a lower end of the guide surface, and an upper end of the oblique surface is lower than the upper end of the guide surface.

In certain embodiments, a horizontal distance from the upper end of the guide surface to the vertical center line is equal to a horizontal distance from the lower end of the guide surface to the vertical center line.

In certain embodiments, each of the terminals is provided with a base, two connecting portions are formed by bending and extending from two opposite sides of the base, the two clamping portions are formed by extending downward from the two connecting portions and close to each other, and when the pins are inserted downward, the guide surfaces of the pins match with the bases of the terminals to guide the pins to move downward.

In certain embodiments, each of the accommodating holes has two covering portions opposite to each other, an upper end of the base of each of the terminals is exposed upward to a corresponding one of the accommodating holes, and the covering portions cover upper ends of the connecting portions.

In certain embodiments, in an upward-from-bottom direction, the base is inclined toward the two clamping portions, and when each of the pins is inserted downward to the final position, the base of a corresponding one of the terminals is in contact with each of the pins.

In certain embodiments, the base is provided with a through hole, a mating portion is formed by bending from an upper end of the through hole toward the two clamping portions and extending downward, and when each of the pins is inserted downward to the final position, the mating portion of a corresponding one of the terminals is in contact with each of the pins.

A plug is configured to be inserted downward into a socket connector having a plurality of terminals. The plug includes a body, and a plurality of pins positioned on the body, wherein each of the pins has an insertion portion extending downward out of the body, the insertion portion is provided with a guide surface, the guide surface passes through a vertical center line of the insertion portion, the insertion portion is further provided with two contact regions being higher than the guide surface, and the guide surfaces of the pins guide the pins to be inserted downward into the socket connector; wherein when each of the pins is inserted downward to a final position, the contact regions are in contact with a corresponding one of the terminals, and the guide surface is not in contact with the corresponding one of the terminals.

In certain embodiments, the pins are divided into two groups, the guide surfaces of the pins in a same group of the two groups extend in a same direction, and the guide surfaces of two pins in the two different groups extend in opposite directions.

In certain embodiments, a side surface of the insertion portion has two first flat surfaces opposite to each other, and a second flat surface and a third flat surface opposite to each other and located at two opposite sides of the first flat surfaces, wherein a bottom end of the second flat surface is higher than a bottom end of the third flat surface, the two contact regions are respectively provided on the two first flat surfaces, and an upper end of the guide surface is connected to the bottom end of the second flat surface.

In certain embodiments, an oblique surface extends downward from the bottom end of the third flat surface, and the oblique surface is connected to the guide surface.

In certain embodiments, a lower end of the guide surface is connected to the bottom end of the third flat surface.

In certain embodiments, the second flat surface is provided with a mating region, and when each of the pins is inserted downward to the final position, the mating region is in contact with the corresponding one of the terminals.

In certain embodiments, the guide surface is connected to the two first flat surfaces.

Compared with the related art, the electrical connector assembly and plug according to certain embodiments of the present invention have the following beneficial effects:

The guide surface passes through the vertical center line of the insertion portion, prolonging the guiding path of the guide surface for guiding each pin to be inserted downward, such that the pins can be smoothly and correctly inserted, the terminals are not easily damaged, and each pin is more accurately in contact with the two clamping portions.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
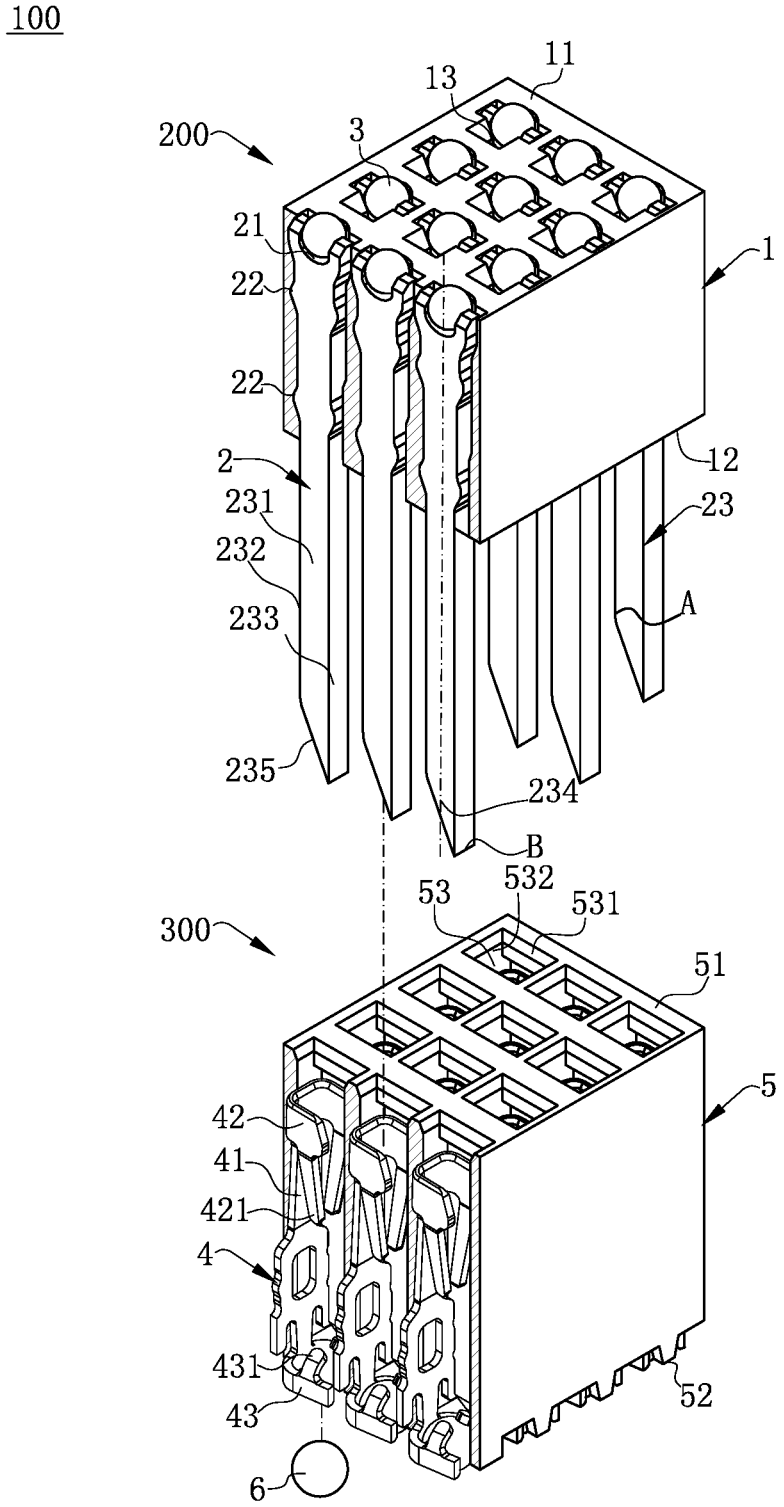
FIG. 1 is a perspective sectional view of a socket connector and a plug of the electrical connector assembly according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper,"

depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector assembly and a plug.

FIG. 1 to FIG. 7 show an electrical connector assembly 100 according to a first embodiment of the present invention, which includes a plug 200 and a socket connector 300 mated with the plug 200.

As shown in FIG. 1, the plug 200 includes a body 1, multiple pins 2 positioned on the body 1, and multiple tin balls 3 correspondingly fixed to the pins 2.

As shown in FIG. 1, the body 1 has a top surface 11 and a bottom surface 12 opposite to each other vertically, and multiple through slots 13 running through the top surface 11 and the bottom surface 12 vertically.

As shown in FIG. 1, each pin 2 is in a flat shape, and is accommodated in a corresponding through slot 13. A recess 21 is downward concavely formed on a top end of the pin 2 to fix a corresponding tin ball 3 to be connected to an external electronic component (not shown). A bottom surface of the recess 21 is an arc-shaped surface matching the surface of the tin ball 3. Two opposite sides of the pin 2 are provided with multiple barbs 22, and the barbs 22 are in interference fit with the through slot 13 to fix the pin 2.

Figure 6:
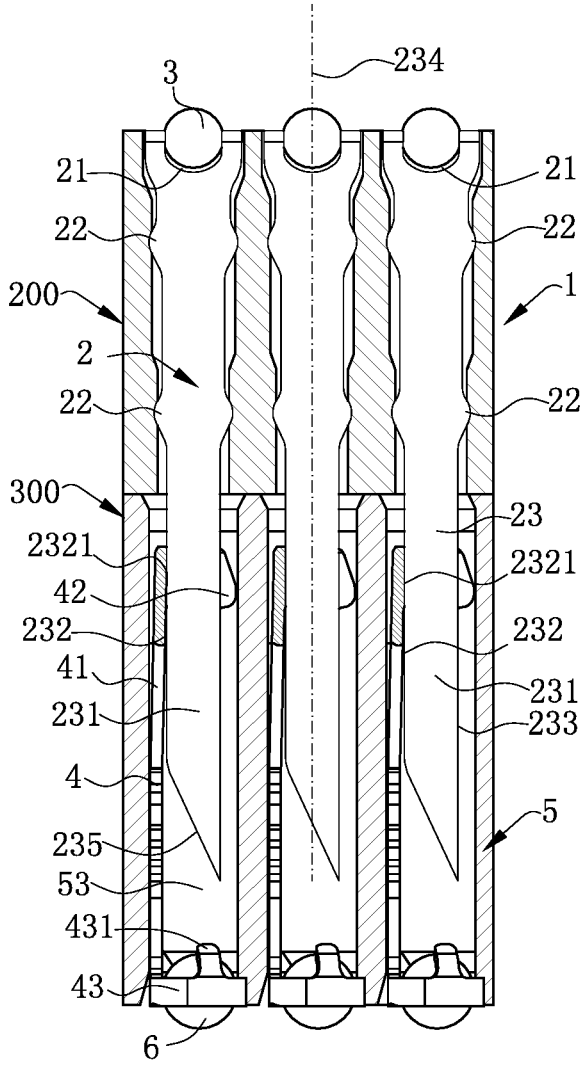
FIG. 6 is a sectional view of the plug of the electrical connector assembly in FIG. 5 being inserted to the final position and the socket connector along one direction according to the first embodiment.
Figure 7:
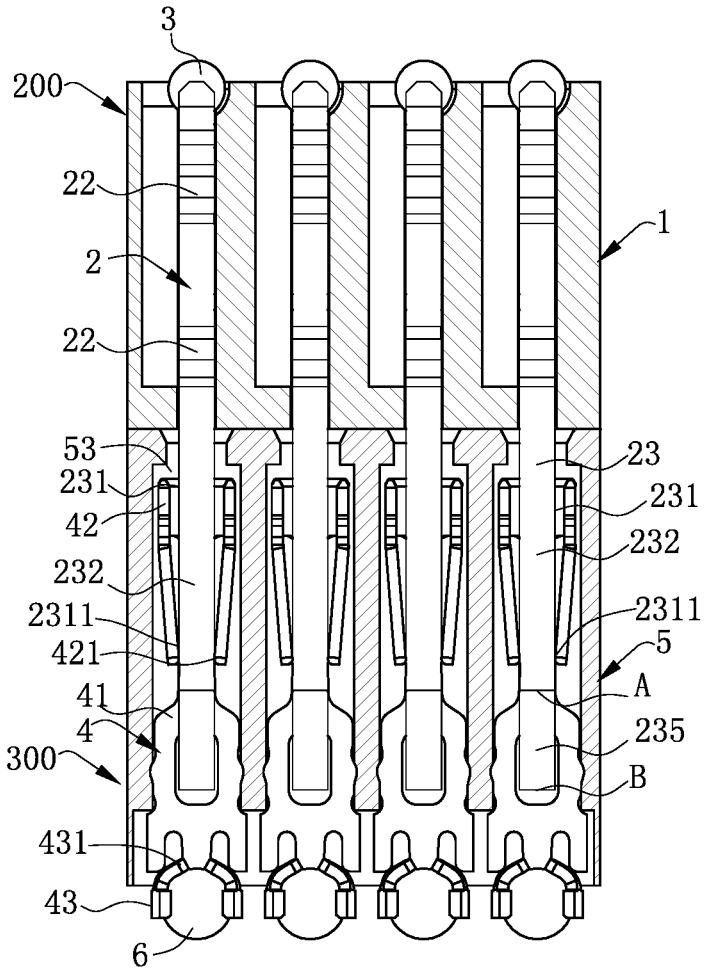
FIG. 7 is a sectional view of the plug of the electrical connector assembly in FIG. 6 being inserted to the final position with the socket connector along another direction according to the first embodiment.

As shown in FIG. 1, FIG. 6 and FIG. 7, each pin 2 has an insertion portion 23 extending from the bottom surface 12 of the body 1. The side surface of the insertion portion 23 has two first flat surfaces 231 opposite to each other, and a second flat surface 232 and a third flat surface 233 opposite to each other, located on two opposite sides of the two first flat surfaces 231 and respectively connected to the two first flat surfaces 231. A bottom end of the second flat surface 232 is higher than a bottom end of the third flat surface 233. Each of the two first flat surfaces 231 is respectively provided with a contact region 2311, and the second flat surface 232 is provided with a mating region 2321. The insertion portion 23 defines a vertical center line 234, which is a virtual line passing the center of the insertion portion 23, and a horizontal distance from the vertical center line 234 to the second flat surface 232 is equal to a horizontal distance from the vertical center line 234 to the third flat surface 233.

As shown in FIG. 1 and FIG. 7, the insertion portion 23 is provided with a guide surface 235 extending to a lowest position of the insertion portion 23. The guide surface 235 is an oblique surface (or may alternatively be an arc surface in other embodiments). An upper end A of the guide surface 235 is connected to the bottom end of the second flat surface 232, a lower end B of the guide surface 235 is connected to the bottom end of the third flat surface 233, and two opposite sides of the guide surface 235 are connected to the two first flat surfaces 231. The guide surface 235 passes through the vertical center line 234 of the insertion portion 23, and a horizontal distance from the upper end A of the guide surface 235 to the vertical center line 234 of the insertion portion 23 is equal to a horizontal distance from the lower end B of the guide surface 235 to the vertical center line 234 of the insertion portion 23.

Figure 2:
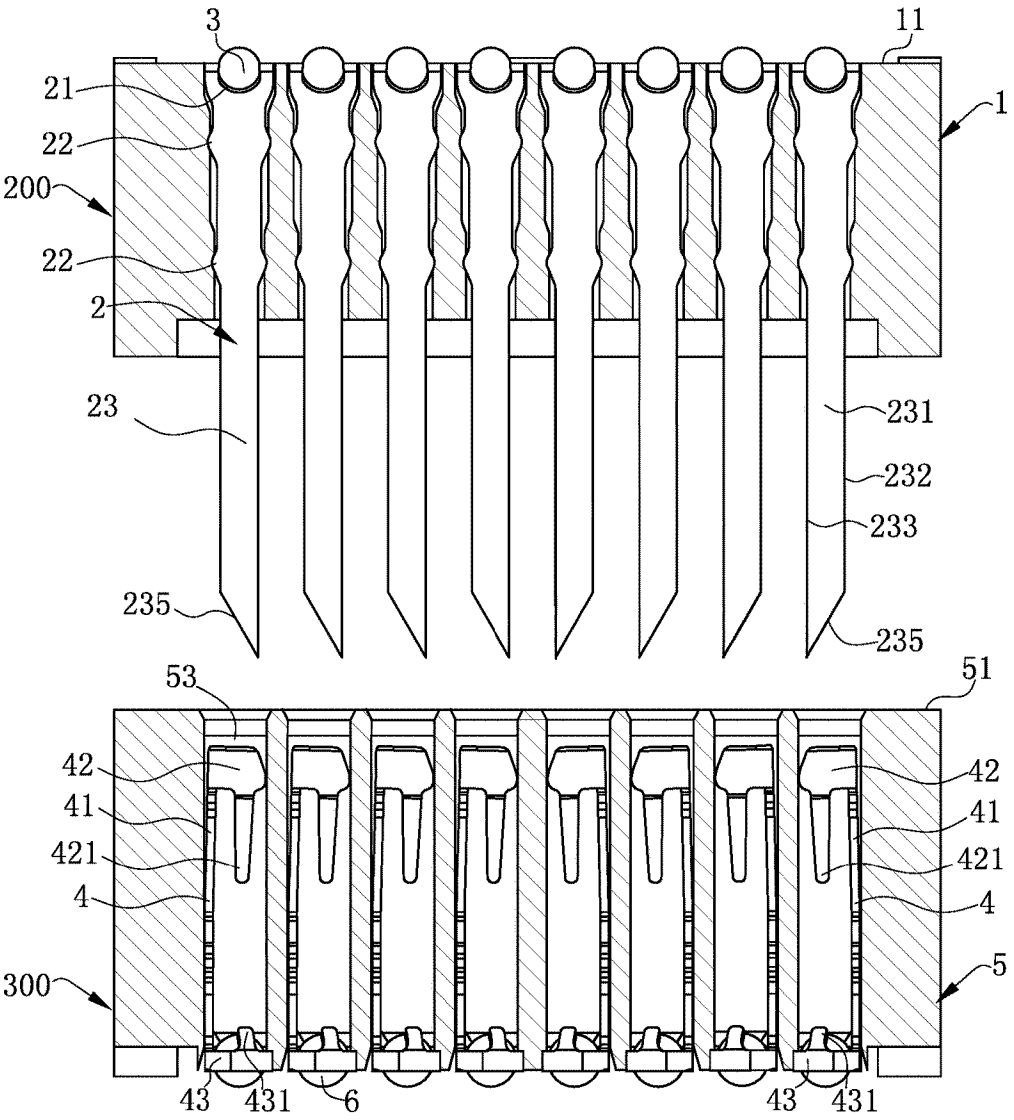
FIG. 2 is a planar sectional view of the socket connector and the plug of the electrical connector assembly according to the first embodiment of the present invention.

As shown in FIG. 2, the pins 2 are equally divided into two groups. The guide surfaces 235 of the pins 2 in a same group extend in the same direction, and the guide surfaces 235 of two pins 2 in different groups extend in opposite directions. That is, the guide surfaces 235 of the two pins 2 in different groups are provided opposite to each other.

Figure 3:
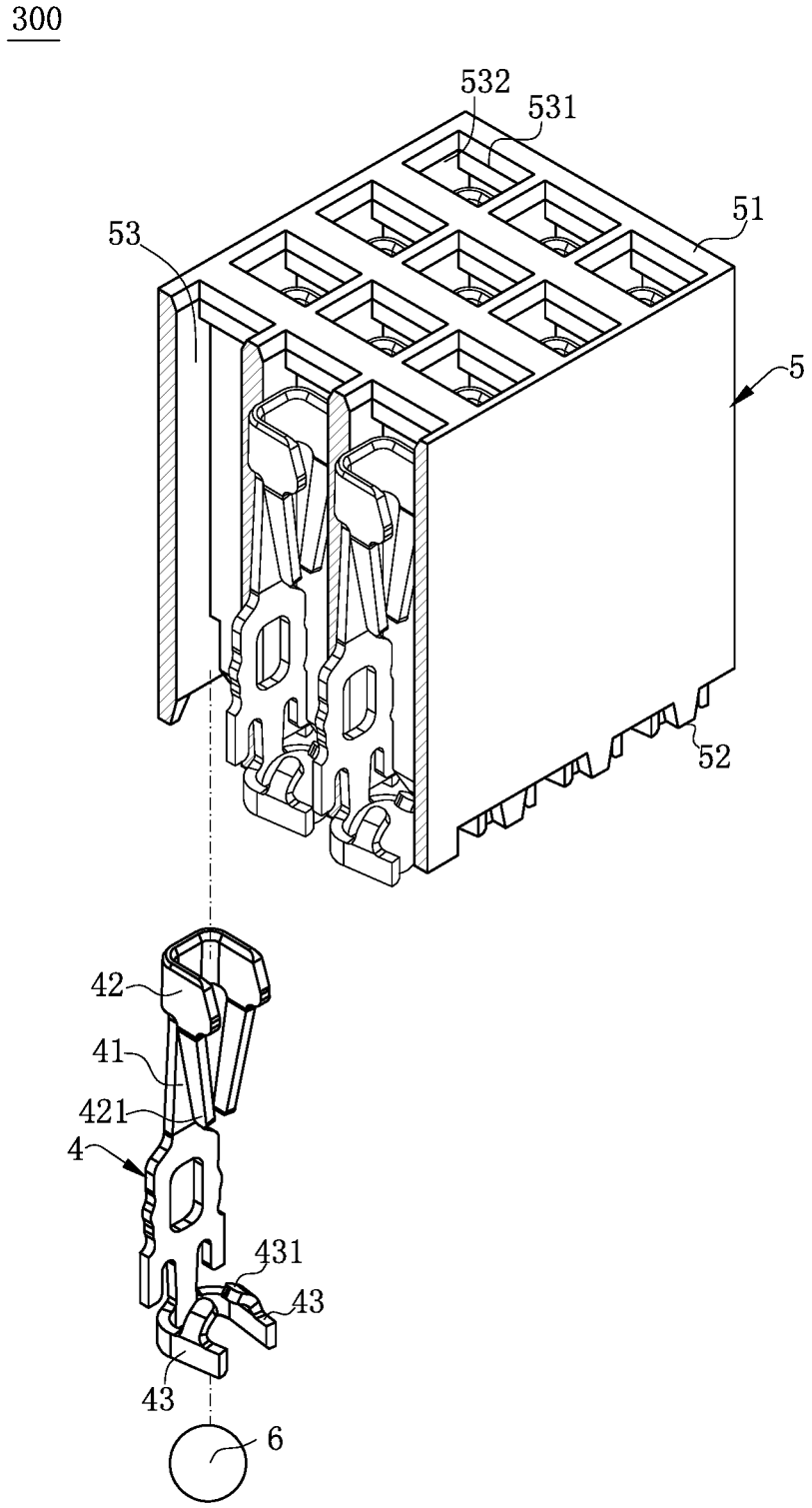
FIG. 3 is a perspective sectional view of the socket connector of the electrical connector assembly in FIG. 1 according to the first embodiment.

As shown in FIG. 3, the socket connector 300 includes an insulating body 5 and multiple terminals 4 accommodated in the insulating body 5.

As shown in FIG. 3, FIG. 6 and FIG. 7, each terminal 4 is provided with a base 41. Two connecting portions 42 are formed by bending and extending from two opposite sides of the base 41, and two clamping portions 421 are formed by extending downward from the two connecting portions 42 and close to each other. In an upward-from-bottom direction, the base 41 is inclined toward the two clamping portions 421, such that when each pin 2 is inserted downward to the final position, the base 41 is in contact with the mating region 2321 of the pin 2. A soldering portion 43 is connected to the bottom end of the base 41. The soldering portion 43 is approximately in a C shape. Two stopping portions 431 extends upward from the soldering portion 43. The two stopping portions 431 approach to each other along the upward-from-bottom direction. The soldering portion 43 clamps a solder 6 to be soldered with a circuit board (not shown), and the stopping portions 431 are configured to stop the solder 6 from excessively moving upward.

As shown in FIG. 2 and FIG. 6, the terminals 4 are equally divided into a first group and a second group, and an inclination direction of the bases 41 of the terminals 4 in the first group is opposite to an inclination direction of the bases 41 of the terminals 4 in the second group. Therefore, when the pins 2 are in contact with the terminals 4, a horizontal component force of the base 41 of a terminal 4 in the first group acting on the mating region 2321 of the corresponding pin 2 is offset by a horizontal component force of the base 41 of a terminal 4 in the second group acting on the mating region 2321 of the corresponding pin 2, thereby preventing the pins 2 from being only subjected to a horizontal acting force in one direction during insertion, and ensuring the plug 200 to be smoothly inserted.

Figure 4:
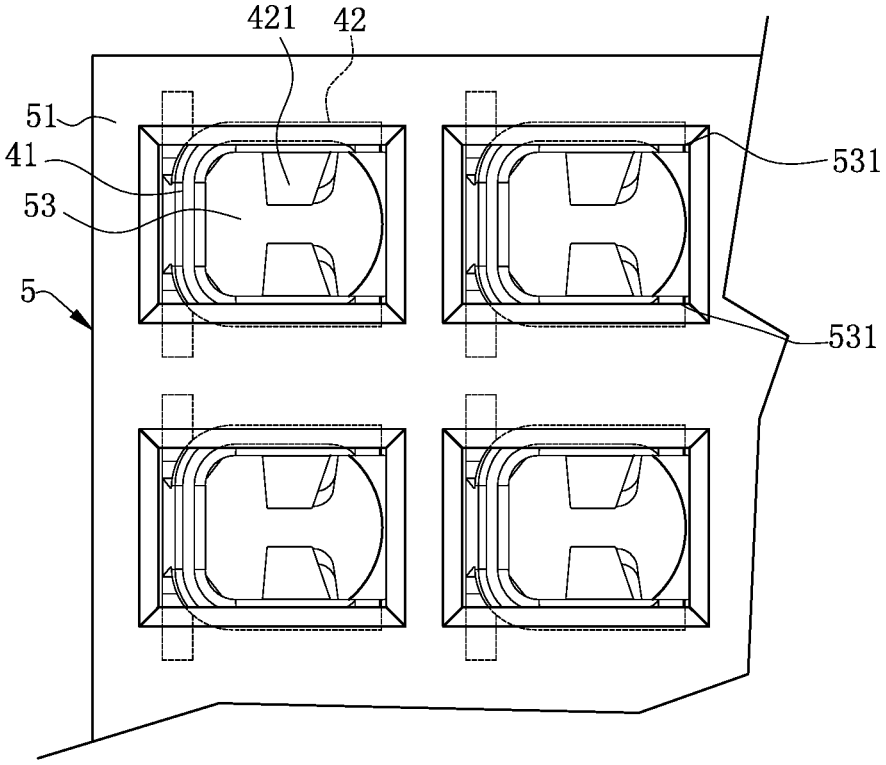
FIG. 4 is a top view of a socket connector of the electrical connector assembly in FIG. 3 according to the first embodiment.

As shown in FIG. 3 and FIG. 4, the insulating body 5 has an upper surface 51 and a lower surface 52. The insulating body 5 is provided with multiple accommodating holes 53, and the accommodating holes 53 run through the upper surface 51 and the lower surface 52 of the insulating body 5. The terminals 4 are accommodated in the accommodating holes 53. Each of the accommodating holes 53 has two opposite covering portions 531. The upper end of the base 41 is exposed upward to the corresponding accommodating hole 53, and the covering portions 531 cover the upper ends of the connecting portions 42.

Figure 5:
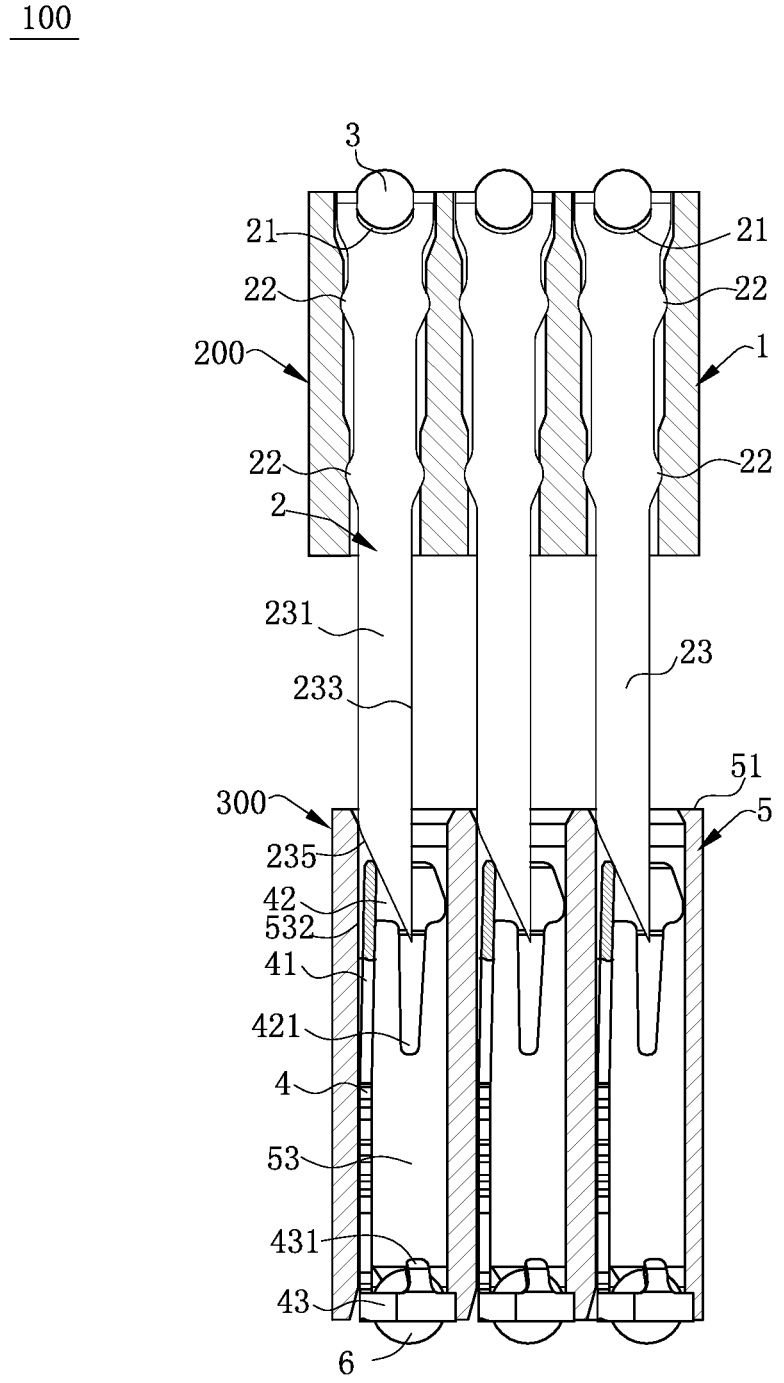
FIG. 5 is a sectional view of the plug of the electrical connector assembly in FIG. 1 being guided to be inserted into the socket connector along one direction according to the first embodiment.

As shown in FIG. 5, when the pins 2 are inserted downward into the accommodating holes 53, the guide surface 235 of each pin 2 matches with and abuts the upper end of the base 41 of the corresponding terminal 4 and guides the pin 2 to move downward. The base 41 moves toward a side wall 532 of the corresponding accommodating hole 53 under the acting force of the pin 2, such that a clearance between the base 41 and the side wall 532 of the corresponding accommodating hole 53 is reduced.

As shown in FIG. 6 and FIG. 7, when each pin 2 moves downward to the final position, the insertion portion 23 is completely accommodated in the corresponding accommodating hole 53. The base 41 is in contact with the mating region 2321, and the two clamping portions 421 clamp the two first flat surfaces 231 of the insertion portion 23 and are in contact with the two contact regions 2311. The guide surface 235 is located below the contact regions 2311 and is not in contact with the corresponding terminal 4. The pin 2 forms a three-point contact with the corresponding terminal 4 such that signal transmission becomes more stable.

Figure 8:
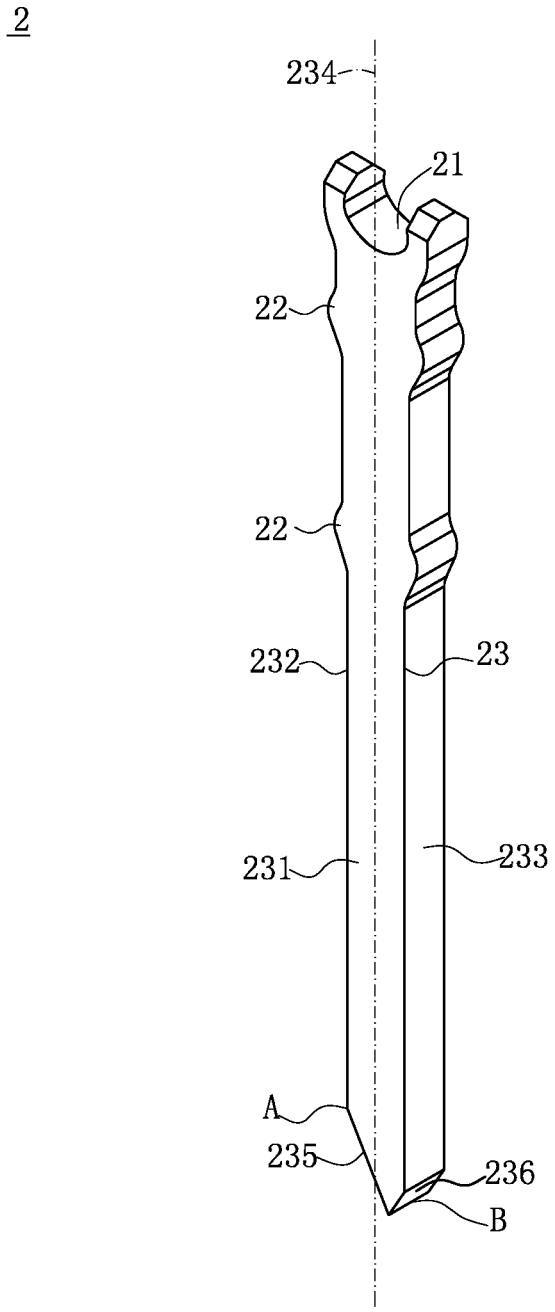
FIG. 8 is a perspective view of a pin of the electrical connector assembly according to another embodiment of the present invention.

FIG. 8 shows a pin 2 according to another embodiment of the present invention, which is different from the pin 2 in the first embodiment mainly in that the insertion portion 23 is provided with an oblique surface 236. An upper end of the oblique surface 236 is connected to the bottom end of the third flat surface 233, a lower end of the oblique surface 236 is connected to the lower end B of the guide surface 235, and two opposite sides of the oblique surface 236 are connected to the two first flat surfaces 231. The upper end of the oblique surface 236 is lower than the upper end A of the guide surface 235, and the extension direction of the oblique surface 236 is opposite to the extension direction of the guide surface 235. The guide surface 235 passes through the vertical center line 234 of the insertion portion 23, and a horizontal distance from the upper end A of the guide surface 235 to the vertical center line 234 of the insertion portion 23 is greater than a horizontal distance from the lower end B of the guide surface 235 to the vertical center line 234 of the insertion portion 23.

Figure 9:
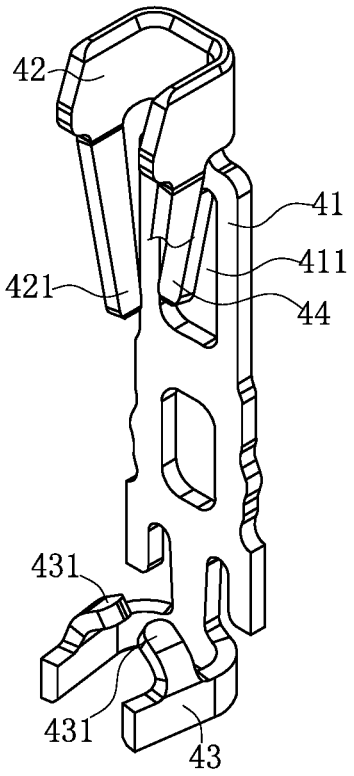
FIG. 9 is a perspective view of a terminal of the electrical connector assembly according to another embodiment of the present invention.

FIG. 9 shows a terminal 4 according to another embodiment of the present invention, which is different from the terminal 4 in the first embodiment in that the base 41 of the terminal 4 is vertical, and is not in direct contact with the mating region 2321 of the corresponding pin 2. Instead, the base 41 is provided with a through hole 411, and a mating portion 44 is formed by bending from the upper end of the through hole 411 toward the two clamping portions 421 and extending downward, such when the corresponding pin 2 is inserted downward to the final position, the mating portion 44 is mated with the mating region 2321.

In certain embodiments, the terminal 4 and the pin 2 as described in each of the embodiments as described above may be used to match with each other in any combination thereof. For example, the pin 2 as shown in FIG. 8 may be matched with the terminal 4 as described in the first embodiment. Alternately, the terminal 4 as shown in FIG. 9 may be matched with the pin 2 as described in the first embodiment. Alternately, the pin 2 as shown in FIG. 8 may be matched with the terminal 4 as shown in FIG. 9.

To sum up, the electrical connector assembly 100 according to certain embodiments of the present invention has the following beneficial effects:

(1) The guide surface 235 passes through the vertical center line 234 of the insertion portion 23, prolonging the guiding path of the guide surface 235 for guiding each pin 2 to be inserted downward, such that the pins 2 can be smoothly and correctly inserted, the terminals 4 are not easily damaged, and each pin 2 is more accurately in contact with the two clamping portions 421.

(2) The covering portions 531 cover the upper ends of the connecting portions 42, preventing the pin 2 from colliding with the upper end of the connecting portions 42 and causing the damage of the connecting portions 42.

(3) When each pin 2 is inserted downward to the final position, the two contact regions 2311 and the mating region 2321 of the pin 2 form a three-point contact with the corresponding terminal 4 such that the transmission signal becomes more stable.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

a plug, comprising a body and a plurality of pins positioned on the body, wherein each of the pins has an insertion portion extending downward out of the body, the insertion portion is provided with a guide surface extending obliquely upward, the guide surface passes through a vertical center line of the insertion portion, and the insertion portion is further provided with two contact regions being higher than the guide surface; and a socket connector, comprising an insulating body, wherein the insulating body is provided with a plurality of accommodating holes running through the insulating body vertically, a plurality of terminals are correspondingly accommodated in the accommodating holes respectively, each of the terminals is provided with two clamping portions, and the guide surfaces of the pins guide the pins to be inserted downward into the accommodating holes;

wherein when each of the pins is inserted downward to a final position, the insertion portion is located between the two clamping portions, the two clamping portions are correspondingly in contact with the two contact regions, and the guide surface is located below the two clamping portions; and wherein each of the terminals is provided with a base, two connecting portions are formed by bending and extending from two opposite sides of the base, the two clamping portions are formed by extending downward from the two connecting portions and close to each other, and when the pins are inserted downward, the guide surfaces of the pins match with the bases of the terminals to guide the pins to move downward.

2. The electrical connector assembly according to claim 1, wherein the guide surfaces of a portion of the pins are provided opposite to the guide surfaces of another portion of the pins.

3. The electrical connector assembly according to claim 1, wherein a side surface of the insertion portion has two first flat surfaces opposite to each other and a second flat surface connecting the two first flat surfaces, the two contact regions are respectively provided on the two first flat surfaces, an upper end of the guide surface is connected to a bottom end of the second flat surface, and two opposite sides of the guide surface are connected to the two first flat surfaces.

4. The electrical connector assembly according to claim 1, wherein an oblique surface is connected to a lower end of the guide surface, and an upper end of the oblique surface is lower than the upper end of the guide surface.

5. The electrical connector assembly according to claim 1, wherein a horizontal distance from the upper end of the guide surface to the vertical center line is equal to a horizontal distance from the lower end of the guide surface to the vertical center line.

6. The electrical connector assembly according to claim 1, wherein each of the accommodating holes has two covering portions opposite to each other, an upper end of the base of each of the terminals is exposed upward to a corresponding one of the accommodating holes, and the covering portions cover upper ends of the connecting portions.

7. The electrical connector assembly according to claim 1, wherein in an upward-from-bottom direction, the base is inclined toward the two clamping portions, and when each of the pins is inserted downward to the final position, the base of a corresponding one of the terminals is in contact with each of the pins.

8. The electrical connector assembly according to claim 1, wherein the base is provided with a through hole, a mating portion is formed by bending from an upper end of the through hole toward the two clamping portions and extending downward, and when each of the pins is inserted downward to the final position, the mating portion of a corresponding one of the terminals is in contact with each of the pins.

9. A plug, configured to be inserted downward into a socket connector having a plurality of terminals, the plug comprising:

a body; and a plurality of pins positioned on the body, wherein each of the pins has an insertion portion extending downward out of the body, the insertion portion is provided with a guide surface extending obliquely upward, the guide surface passes through a vertical center line of the insertion portion, the insertion portion is further provided with two contact regions being higher than the guide surface, and the guide surfaces of the pins guide the pins to be inserted downward into the socket connector;

wherein when each of the pins is inserted downward to a final position, the contact regions are in contact with a corresponding one of the terminals, and the guide surface is not in contact with the corresponding one of the terminals; and wherein the pins are divided into two groups, the guide surfaces of the pins in a same group of the two groups extend in a same direction, and the guide surfaces of two pins in the two different groups extend in opposite directions.

10. The plug according to claim 9, wherein a side surface of the insertion portion has two first flat surfaces opposite to each other, and a second flat surface and a third flat surface opposite to each other and located at two opposite sides of the first flat surfaces, wherein a bottom end of the second flat surface is higher than a bottom end of the third flat surface, the two contact regions are respectively provided on the two first flat surfaces, and an upper end of the guide surface is connected to the bottom end of the second flat surface.

11. The plug according to claim 10, wherein an oblique surface extends downward from the bottom end of the third flat surface, and the oblique surface is connected to the guide surface.

12. The plug according to claim 10, wherein a lower end of the guide surface is connected to the bottom end of the third flat surface.

13. The plug according to claim 10, wherein the second flat surface is provided with a mating region, and when each of the pins is inserted downward to the final position, the mating region is in contact with the corresponding one of the terminals.

14. The plug according to claim 10, wherein the guide surface is connected to the two first flat surfaces.

15. A plug, configured to be inserted downward into a socket connector having a plurality of terminals, the plug comprising:

a body; and a plurality of pins positioned on the body, wherein each of the pins has an insertion portion extending downward out of the body, the insertion portion is provided with a guide surface, the guide surface extends obliquely upward in a width direction of the insertion portion such that a width of the insertion portion gradually increases along an upward direction from a bottom of the guide surface, the guide surface passes through a vertical center line of the insertion portion, the insertion portion is further provided with two contact regions being higher than the guide surface, and the guide surfaces of the pins guide the pins to be inserted downward into the socket connector;

wherein when each of the pins is inserted downward to a final position, the contact regions are in contact with a corresponding one of the terminals, and the guide surface is not in contact with the corresponding one of the terminals.

16. The plug according to claim 15, wherein a side surface of the insertion portion has two first flat surfaces opposite to each other, and a second flat surface and a third flat surface opposite to each other and located at two opposite sides of the first flat surfaces, wherein a bottom end of the second flat surface is higher than a bottom end of the third flat surface, the two contact regions are respectively provided on the two first flat surfaces, and an upper end of the guide surface is connected to the bottom end of the second flat surface.

17. The plug according to claim 16, wherein an oblique surface extends downward from the bottom end of the third flat surface, and the oblique surface is connected to the guide surface.

18. The plug according to claim 16, wherein a lower end of the guide surface is connected to the bottom end of the third flat surface.

19. The plug according to claim 16, wherein the second flat surface is provided with a mating region, and when each of the pins is inserted downward to the final position, the mating region is in contact with the corresponding one of the terminals.

20. The plug according to claim 16, wherein the guide surface is connected to the two first flat surfaces.

* * * * *